US005140306A

United States Patent [19]

Hemphill, Sr.

[11] Patent Number: 5,140,306

[45] Date of Patent: Aug. 18, 1992

[54] ALARM INDICATING SYSTEM

[76] Inventor: Francis A. Hemphill, Sr., 331 Slade, Haysville, Kans. 67060

[21] Appl. No.: 609,905

[22] Filed: Nov. 6, 1990

Related U.S. Application Data

[63] Continuation-in-part of Ser. No. 293,215, Jan. 4, 1989, abandoned.

[51] Int. Cl.[5] ..... G08B 25/00

[52] U.S. Cl. ..... 340/524; 340/506; 340/514; 340/513; 340/534; 340/825.36

[58] Field of Search ..... 340/524, 506, 500, 507-515, 340/531, 533, 534, 537, 825.3, 825.32, 825.31, 825.49, 825.56, 825.06, 825.36

[56] References Cited

U.S. PATENT DOCUMENTS

| | | | |
|---|---|---|---|
| 3,613,091 | 10/1971 | Northfield et al. | 340/347 |
| 3,613,093 | 10/1971 | Relay et al. . | |
| 4,001,785 | 1/1977 | Miyazaki et al. . | |
| 4,032,908 | 6/1977 | Rice et al. . | |
| 4,191,948 | 3/1980 | Stockdale | 340/539 |
| 4,227,180 | 10/1980 | Yasuda et al. | 340/166 |
| 4,257,038 | 3/1981 | Rounds et al. | 340/539 |
| 4,262,286 | 4/1981 | Tanigawa | 340/584 |
| 4,308,911 | 1/1982 | Mandl | 165/22 |
| 4,410,884 | 10/1983 | Heiland | 340/545 |
| 4,470,039 | 9/1984 | McBrian | 340/514 |
| 4,531,114 | 7/1985 | Topol et al. | 340/539 |
| 4,538,138 | 8/1985 | Harvey et al. | 340/521 |
| 4,549,168 | 10/1985 | Sieradzki | 340/525 |

FOREIGN PATENT DOCUMENTS

| | | | |
|---|---|---|---|
| 2426875 | 12/1975 | Fed. Rep. of Germany | 340/825.49 |

*Primary Examiner*—Donnie L. Crosland

*Attorney, Agent, or Firm*—Pravel, Gambrell, Hewitt, Kimball & Krieger

[57] ABSTRACT

An alarm indicating system utilizing a plurality of remote sensors connected to a wired-OR address bus, the sensors having means for forming a binary address which is placed on the address bus as a series of high and low signal levels when the remote sensor is activated. The system includes a plurality of comparators, each having a binary address corresponding to a remote sensor. The comparators detect the activation of its corresponding remote sensor by monitoring the address bus for presence of the designated address and activating a central alarm indicating system. The system also includes a testing means which can present test addresses onto the address bus, thereby activating the sensors and testing the operation of the comparators. The system includes a means for disabling the testing means when a remote sensor is activated by an external alarm, and therefore the testing means does not interfere with the operation of the system.

8 Claims, 3 Drawing Sheets

INHIBIT LINE
TEST ADDRESS ENABLE SIGNAL
152
154
156
158

RECORDER
125
PARALLEL OUT SERIAL SHIFT REGISTER
121
DRIVER CIRCUITRY
122
CLOCK
124
CLEAR
COUNTER
120
+16V
132
HORN RESET SWITCH
128
130
S
R
Q
Q̄
140
61
OUTPUT PREVENT
INHIBIT LINE
123
40
G
F
E
D
C
B
A
H
I
INHIBIT OVERRIDE LINE
RESET LINE
63
62
33

ALARM INDICATING SYSTEM

This application is a continuation-in-part of co-pending U.S. patent application Ser. No. 293,215 filed Jan. 4, 1989 now abandoned for "Alarm Indicating System."

BACKGROUND OF THE INVENTION

1. Field of the Invention

The present invention relates to monitoring systems, such as security or fire alarm systems, wherein a plurality of remote sensors of varying types are in signal communication with a central monitoring system which tests and detects changes in status of the remote sensors and activates a central alarm indicating the location of a remote sensor which has been activated.

2. Description of the Prior Art

In known monitoring systems, such as fire or security alarm systems, it has been a practice for each of the remote sensors to be individually connected to the central monitor, requiring that a separate pair of connectors connect the sensor with the central monitoring unit. An example of this type of system includes U.S. Pat. No. 4,032,908, wherein a plurality of remote sensors, each sensor being connected to the central monitor by a conductor pair, are scanned in sequence, permitting the central monitor to compare the remote sensors with their previous states. The disadvantage of this type of system lies in the time, effort and cost required to install such a system, in particular the running or cabling of conductors from the remote sensors to the central monitoring system. Further, the incremental addition of a sensor to an existing system results in inordinately high associated costs due to cabling and installation costs.

Other known systems have recognized the expense associated with connecting remote sensors by means of pairs of lines and have attempted to address this problem. Known systems have utilized a single conductor to connect a remote sensor to the central unit. However, the reduction in cabling material and installation costs is insignificant. Examples of this type of system include U.S. Pat. No. 4,549,168, U.S. Pat. No. 4,001,785, and U.S. Pat. No. 4,470,039, wherein single conductors are used to connect the remote sensors to the central monitoring system.

Still other known systems have addressed this problem through the use of "intelligent" systems designed to decrease the number of connections which must be made with the central controller. For example, U.S. Pat. No. 4,538,138 discloses a system wherein a microprocessor is used to control communications from a zone, each zone having a plurality of remote sensors, thereby decreasing the number of connections which must be made with the central processor. Another approach is taken in U.S. Pat. No. 4,410,884, wherein a central monitoring system is used to determine the sequence in which sensors are activated by means of a clock signal driving a counter, thereby decreasing the number of connectors to three and yet not requiring very high levels of complexity in the remote sensor. The problem associated with the intelligent type of system is that they are generally prone to suffer completely disabling failures as a result of the failure of single components and, in addition, the high cost of the various remote sensors and central controllers.

Therefore it is desirable to have a monitoring system which can easily monitor a large number of locations without extensive cabling requirements and yet without the need for expensive and complex electronics on the remote sensors and the central system to include a testing mechanism which can be run periodically to ensure that the monitoring system is operating properly.

SUMMARY OF THE INVENTION

The present invention is directed toward an alarm system which is designed to reduce the cabling costs associated with both installation and incremental addition of remote sensors to the system. The present invention has been designed to reduce the complexity of such systems to the point that a microprocessor based system is not necessary.

The present invention uses a parallel, wired-OR bus to connect a plurality of remote sensors to the central monitoring system. The activation of a remote sensor sets a flip-flop, which triggers a monostable multivibrator or one shot which, in turn, presents a voltage to an array of selectable diodes. The active diodes within the array at each remote sensor installation are selected at the time of installation and represent the unique binary address or location of the remote sensor. The active diodes within the array are used to form the address for the sensor and are connected to an address bus which forms a portion of the wired-OR bus. Therefore, when a sensor is activated, the one shot is triggered and an address is presented on the address bus through the diode address array for a short period of time. Further, the activation of the remote sensor may be used to activate a local alarm such as a horn or warning light.

The central monitoring system is comprised of plurality of comparators, each corresponding to a unique sensor address, which monitor the information placed on the wired-OR bus. Activation of a remote sensor will result in its corresponding comparator detecting its address on the address bus portion of the bus. The comparator within the central monitoring system then activates location reporting devices and sounds a central alarm.

The number of unique binary sensor addresses in the present invention is a function of the number of conductors forming the address bus. In the present invention, the number of unique binary sensor addresses is equal to $2^n - 1$, where n is the number of parallel address conductors forming the address bus portion of the bus. As will be explained later, several conductors within the wired-OR bus are dedicated to testing functions. The use of the parallel address but eliminates the need to run separate conductors from the individual remote sensors to the central monitoring system. In the present invention, the wired-OR bus is cabled through the various sensor zone locations with the address bus configuration being any desired tree structure. This reduces the time, material and, therefore, cost of the initial cable installation. The time and cost involved in adding an incremental remote sensor to an existing system is reduced, as the only cabling required is any necessary extension of the wired-OR bus to the remote sensor generator location and the connection of the remote sensor to the bus.

The present invention further includes a testing mechanism which may be used to periodically test the monitoring system to ensure that the system is operating properly. The testing mechanism includes a counter and associated clocking circuitry which are used to generate various combinations of test addresses which are presented to the address bus portion of the bus. Decoding logic associated with each sensor determines when the respective sensor is being addressed by the test address and triggers the one shot for that sensor. The wired-OR bus includes an inhibit line which is coupled to the decoding logic for each sensor and the central monitoring system and is used to enable the decoding logic for each sensor when a test is being performed. The inhibit line disables the central monitoring system when test addresses are initially placed on the bus by the testing logic in order to prevent the monitoring system from decoding these test addresses as addresses generated by the remote sensors. When the one shot is triggered by the test address, the central monitoring system is enabled to receive the address generated by the one shot as would normally occur if an actual alarm had sounded. In this manner, the operation of the alarm system can be tested. The wired-OR bus includes an inhibit override line which overrides the inhibit line and enables the central monitoring system if a remote sensor should be activated during a test. The testing mechanism also includes a means for recording addresses placed on the address bus during testing to create a log which may be later reviewed to determine which, if any, of the comparators within the central monitoring system are faulty.

The present invention is simple in nature and requires no intelligent devices, such as microprocessors, at the remote sensor locations or the central monitoring system. Therefore, the present invention is less likely to be disabled by a first level failure, such as a microprocessor failure, and is less complex.

Accordingly, the present invention provides a low cost, easily installed alarm monitoring system designed to support a large number of remote sensor devices of varying types. Further, the present invention minimizes the cost associated with adding an incremental remote sensor to an existing alarm monitoring system.

BRIEF DESCRIPTION OF THE DRAWINGS

A better understanding of the invention can be obtained when the following detailed description of exemplary embodiments is considered in conjunction with the following drawings, in which.

DESCRIPTION OF PREFERRED EMBODIMENT

Figure 1:
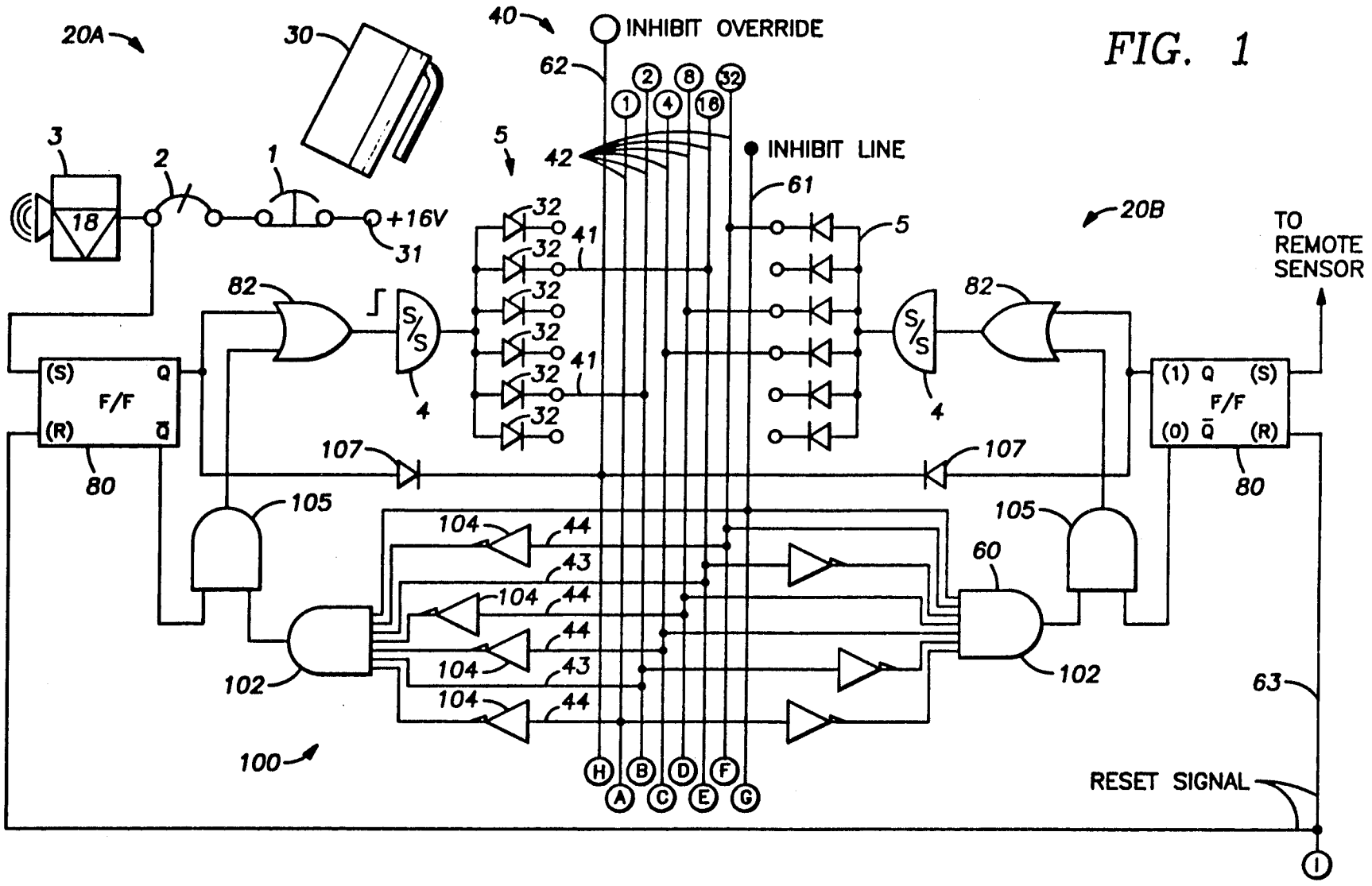
FIG. 1 is an electrical schematic diagram of remote sensors according to the present invention.
Figure 2:
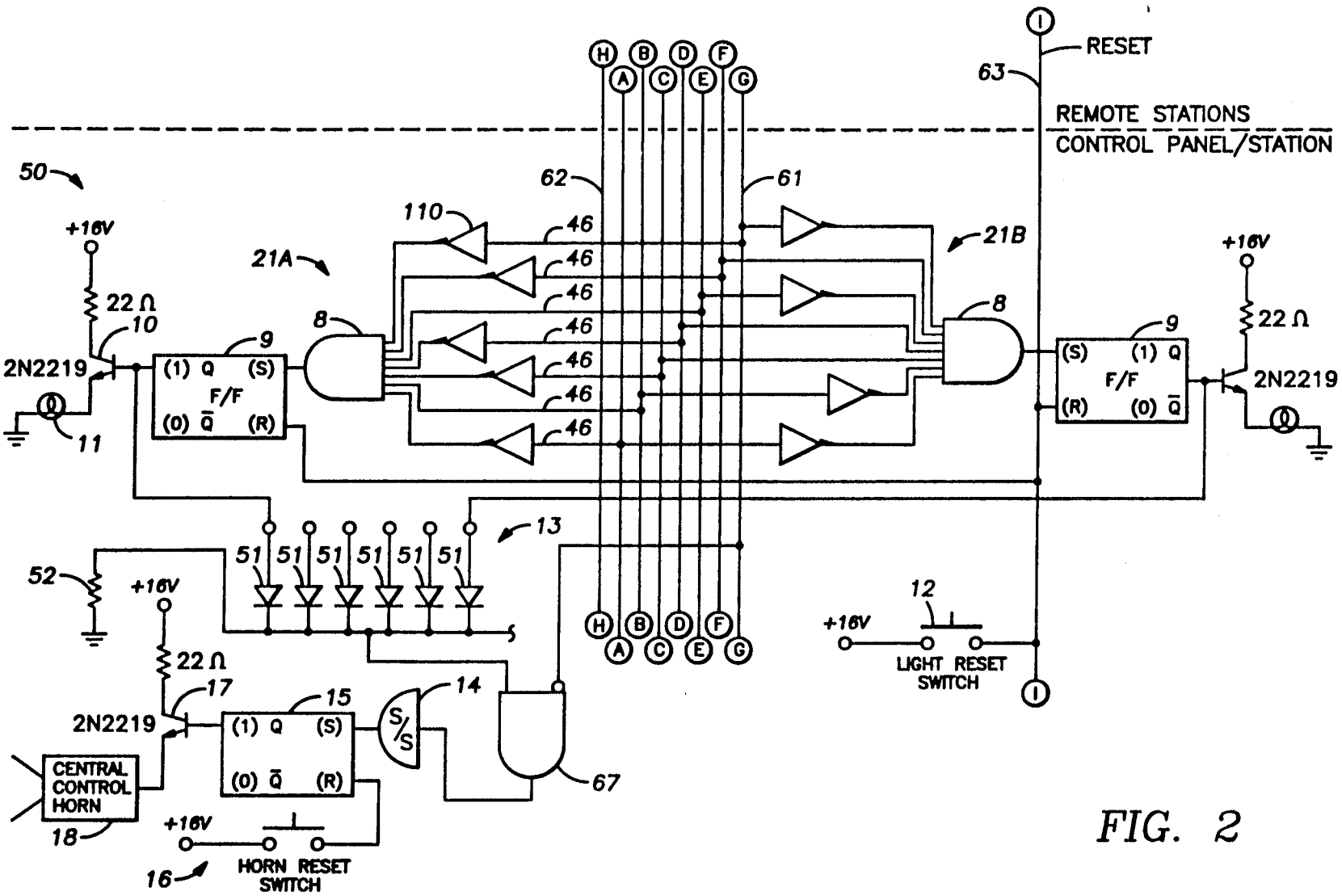
FIG. 2 is an electrical schematic diagram of portions of a central monitoring system according to the present invention.
Figures 3, 4:
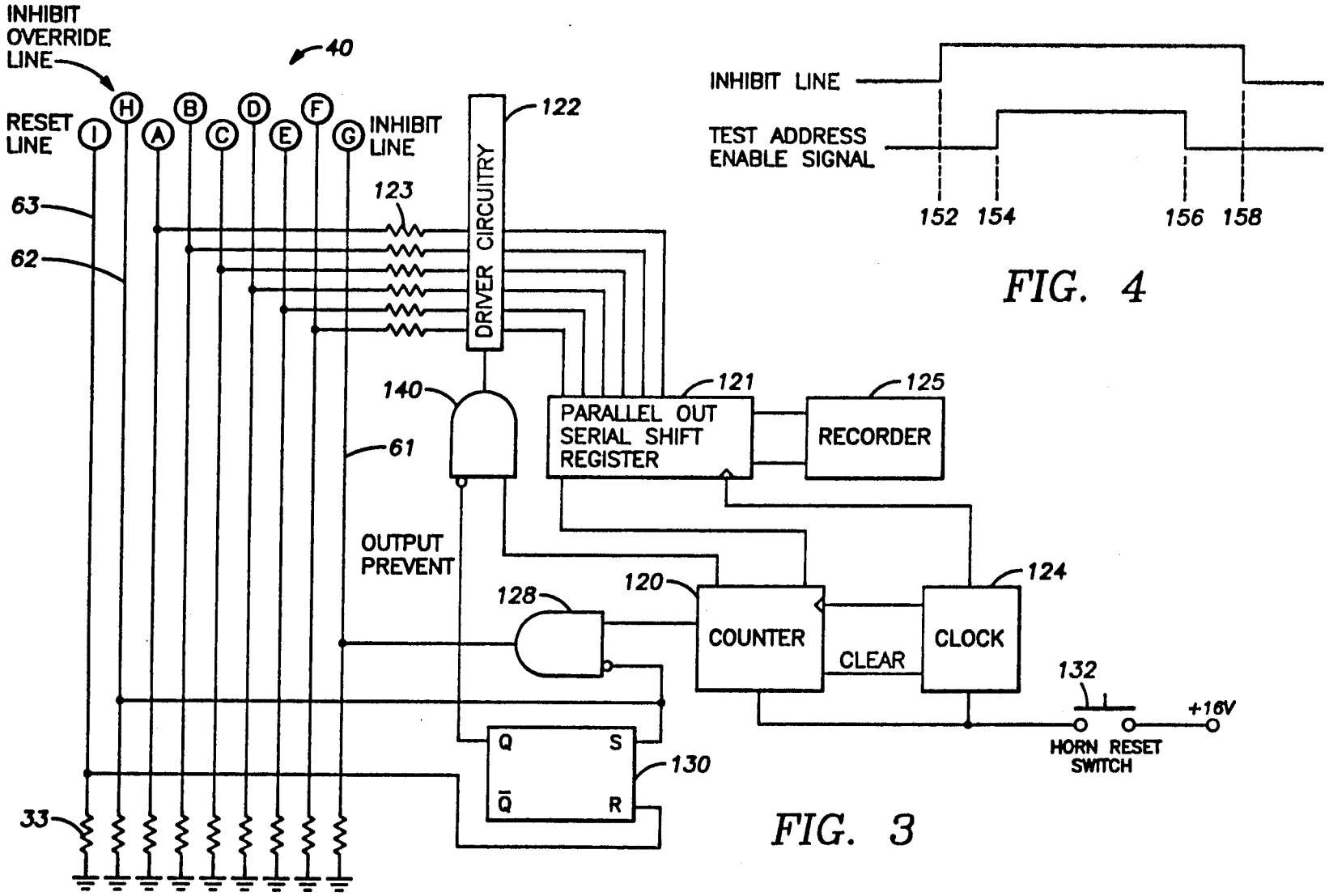
FIG. 3 is an electrical schematic diagram of testing circuitry according to the present invention.
FIG. 4 is a timing diagram illustrating generation of the inhibit line with respect to test addresses.

Referring now to FIGS. 1 through 3, an alarm system according to the present invention is shown. For clarity, the system is shown in three portions with interconnections between FIGS. 1, 2 and 3 designated by reference to the circled letters A through I.

Referring now to FIG. 1, remote sensor stations 20A and 20B according to the present invention are generally shown. Remote sensor stations 20A and 20B are substantially similar, and therefore only remote station 20A is described herein. In FIG. 1, the activating switch 1 is kept open by the weight of a fire extinguisher 30, but it will be appreciated that other sensor types, such as a smoke or heat detectors which provide a contact closure, or switches activated by the opening of a fire exit, removal of a fire hose, activation of an emergency sprinkler system or the like can be utilized in the present invention. When the fire extinguisher 30 is removed, activation switch 1 closes and voltage signal is supplied from a battery 31 to a disabling switch 2. The disabling switch 2 is preferably a key switch and is provided to allow disabling of the remote sensor station 20A if desired. The disabling switch 2 is assumed to be closed for purposes of this discussion. The battery 31 provides power to the components in the remote sensor station 20A and allows the remote sensor station 20A to operate when general electric power is not available. Alternatively, the remote sensor station 20A can be connected to a source of general electrical power for normal operation and includes a battery charging circuit (not shown) to allow emergency operation. Additionally, the remote sensor station 20A may include circuitry (not shown) to indicate the condition of the battery 31, such that when the battery 31 is discharged beyond a desired voltage level, the need for battery replacement may be indicated.

The voltage signal is transmitted through the disabling switch 2 to a local horn alarm 3 and also to the S or set inputs of an S-R flip-flop 80. The Q output of the flip-flop 80 is connected to an input of a two input OR gate 82. The output of the OR gate 82 is connected to a monostable multivibrator or ,one shot 4. Therefore, when the fire extinguisher 30 is lifted, the flip-flop 80 is set. When the one shot 4 senses a rising edge of the input signal from the Q output of the flip-flop 80, it outputs a pulse of short duration which is applied to a diode array 5. The duration of the pulse is generally controlled by resistive and capacitive elements associated with the one shot 4. The duration of the pulse is sufficient to allow recognition by the central monitoring system 50 (FIG. 2) and yet short enough such that overlap of pulses from different remote sensor stations 20A is reduced. The output circuitry of the one shot 4 is such that it can drive the connected loads. The diode array 5 comprises a plurality of individual diodes 32 having their anodes connected together to receive the pulse from the one shot 4. In this embodiment, the diode array 5 is comprised of six diodes 32. The number of diodes 32 within the diode array 5 corresponds to the number of conductors 42 forming the address bus portion of a wired-OR bus 40. Selected cathodes of the individual diodes 32 are connected by means of connector cables 41 to the address bus and are used to form the binary address of the remote sensor.

In the illustrative embodiment, the wired-OR bus 40 comprises six address conductors 42 forming the address bus, an inhibit signal conductor 61, an inhibit override conductor 62, and a reset line 63. The reset line 63 forms a part of the wired-OR bus 40, but is shown separately from the wired-OR bus 40 in FIGS. 1 and 2 for clarity. The six address signal conductors 42 permit $2^6 = 1$, or 63 unique binary sensor addresses to be used within the system. The number of unique remote sensor addresses may be easily increased by adding additional diodes 32 to the diode array 5 and increasing the number of parallel address conductors 42 in the wired-OR bus 40. In general, the number of available addresses correspond to the formulation $2^n - 1$, where n is the number of address conductors 42 and diodes 32 within diode array 5. In FIG. 1, the address conductors 42 represent the binary power values 1, 2, 4, 8, 16, and 32.

The address of the remote sensor station 20A is set by selectively connecting the diodes 32 within diode array 5, which represent the unique binary address of the remote station 20A, to the corresponding address conductors 42 on the address bus. Thus, when the one shot 4 is triggered, a pulse is presented to diode array 5 which creates high output signals which are placed on the appropriate conductors 42 of the address bus by way of the conductor cables 41. For example, in FIG. 1 the address of 18 has been assigned to the remote sensor station 20A. This address is represented in the diode array 5 by selection of the diodes 32 within the diode array 5 which are connected to the address conductors 42 representing the binary power values of 16 and 2. A pulse is transmitted through these selected diodes 32 and transmitted through conductor cable 41 to the address bus conductor 42 lines 16 and 2. Thus, an address of 18, or 010010 in binary notation, is presented on the address bus as a series of high and low signal states on the parallel address conductors 42 forming the address bus. When no address is being asserted on the address bus by a remote sensor station 20A, the level of the conductors 42 is a low level because a series of terminating resistors 33 (FIG. 3) are connected to ground. As a result, the address 000000 is not available as a remote sensor station address.

Each remote station 20A further includes address decoding circuitry 100 which is used during testing the remote station 20A according to the present invention. The address decoding circuitry 100 determines when the remote station 20A is being addressed during a test. The decode circuitry 100 is assigned the binary address of the remote sensor 20A and includes the necessary circuitry to determine if this address is presented on the address bus, and if so, trigger the one shot 4. In the illustrative embodiment, the decode circuitry 100 includes a seven input AND gate 102 as the primary comparison element. The AND gate 102 requires that all inputs received from the address conductors 42 be high or active before a high or active signal is output. The AND gate 102 has a corresponding input for each of the address conductors 42 within address bus. The binary address of 18 is set for the AND gate 102 by connecting the inputs of AND gate 102 to the appropriate address conductors 42 having addresses 16 and 2 by of conductors 42. Because a high or active signal must be received on all inputs of the AND gate 102, inverters 104 are electrically connected to conductors 44 that are used to connect the address conductors 42 representing 32, 8, 4, and 1 to the inputs of the AND gate 102. The inverters 104 are used because the address conductors 42 representing 32, 8, 4, and 1 have 0 values in the generation of the address (18) of the remote sensor 20A. Thus, the AND gate 102 is presented with active or high inputs from all the address conductors 42 forming the address bus. Further, the inhibit signal conductor line 61 is connected to an input of the AND gate 102 to enable the operation of the decode circuitry 100 only when testing is being performed, as is described further below.

The output of the AND gate 102 is connected to the input of an AND gate 105. The $\overline{Q}$ or inverted output of the flip-flop 80 is connected to the other inverted input of the AND gate 105. The Q output of the flip-flop 80 is also connected to the inhibit override conductor 62 through a diode 107. The output of the AND gate 105 is connected to the other input of the OR gate 82. The R or reset input of the flip-flop 80 is connected to reset signal conductor 63. Therefore, when the appropriate address for remote sensor 20A (18) is present on the address conductors 42 and the inhibit line 61 is asserted, signifying that a test is in progress the output of the AND gate 102 is assert If the flip-flop 80 is not set, signifying that the alarm from the remote station 20A has not been activated since the flip-flop 80 was last reset, then the Q output of flip-flop 80 is low, the $\overline{Q}$ output is high and the output of the AND gate 105 is asserted, triggering the one shot 4. The triggered one shot 4 places the address of the remote station 20A onto the address conductors 42 as previously described. It is noted that the original test address and the address placed on the bus 40 by the one shot 4 may both be simultaneously driven onto the bus 40 in this instance for a short period of time. However, dual driving is acceptable in this instance because of he presence of resistors 123 (FIG. 3) coupled between the test address driving circuitry and the wired-OR bus 40, as is explained below.

If the alarm from the remote station 20A is activated either immediately prior to the test being initiated or after the test has begun, then the $\overline{Q}$ output of the flip-flop 80 is asserted low, thereby disabling the output from AND gate 105 and preventing the test address from triggering the one shot 4. The asserted Q output of the flip-flop 80 also asserts a high or active signal on the inhibit override conductor 62, which in turn disables the testing circuitry (FIG. 3), as explained below.

A plurality of remote sensor stations 20A and 20B can be connected to the bus 40. Because of the wired-OR nature of the bus 40, it need only be extended to the region of remote sensor station 20A from the nearest desired location and need not be a run from the central monitoring system 50 (FIG. 2). The circuitry comprising the remote sensor station 20A does not include complex components and so the failure rates and the costs associated with installation and the subsequent addition of remote sensors are reduced.

Referring now to FIG. 2, the central monitoring system 50 includes a plurality of comparator modules 21A and 21B. The wired-OR bus 40, comprised of address conductors 42, inhibit line 61, inhibit override line 62, and reset line 63 in FIGS. 1 and 2, are coupled together through the circled letters A through I, respectively. The comparator modules 21A and 21B correspond to the remote sensors 20A and 20B, respectively. The comparator module 21A is described here for simplicity. The comparator module 21A is assigned the binary address of its corresponding remote sensor 20A and includes the necessary circuitry, similar to the decode circuitry 100 described above, to determine if this address is presented on the address bus, and, if so, trigger the appropriate alarms and indicators. The comparator module 21A includes an AND gate 8 as the primary comparison element. The AND gate 8 requires that all inputs received from the address conductors 42 be high or active before a high or active signal is output. The AND gate 8 has a corresponding input for each of the address conductors 42 forming the address bus. The binary address of 18 (binary 010010) is set for the AND gate 8 by connecting the inputs of AND gate 8 to the appropriate conductors 42 having addresses 16 and 2 by means of conductors 45. Because a high or active signal must be received on all inputs of the AND gate 8, inverters 7 are electrically connected to the conductors 46 which connect the address conductors representing 32, 8, 4, and 1 to the inputs of the AND gate 8. The inverters 7 are used because the address conductors 32, 8, 4, and 1 have 0 values in the generation of the address (18) for the comparator module 21A.

The inhibit signal conductor 61 is connected through an inverter 110 to an input of the AND gate 8. The inhibit signal 61 is asserted high when a test address is presented onto the wired-OR bus 40, thereby disabling the AND gate 8 and preventing the comparator module 21A from misinterpreting the test address on the wired-OR bus as an alarm. The conductors 45 and 46 can directly connect to the AND gate 8 and the inverters 7 and 110, or can be connected to a buffer (not shown) which in turn has its outputs connected to the AND gate 8 and the inverters 7 and 110. The buffers may be used to lower bus 40 loading and to improve the noise immunity of the comparator module 21A.

Therefore, the comparator module 21A includes address decode circuitry similar to the address decode circuitry 100 of FIG. 1. When the illustrated remote sensor station 20A, having the binary address of 18, is activated, either by an actual alarm or by a test address placed on the wired-OR bus 40 and passed through the decode circuitry 100, the address 18 is placed on the address conductors 42, with address lines 16 and 2 going active or high, the address lines 32, 8, 4 and 1 remaining inactive or low. The effect of inverters 7 is to make the remaining address inputs to the AND gate 8, address values 32, 8, 4, and 1, go high or active, thereby causing the output from the AND gate 8 to go high to signal receipt of a signal from the associated remote sensor station 20A. If the proper address for the comparator module 21A is not presented, the output of the AND gate 8 remains low, indicating no activation of the associated remote sensor station 20A. If the address (18) for the comparator module 21A is generated by the test circuitry (FIG. 3) then the inhibit line 61 is active high to disable the AND gate 8 until after the address has passed through the decode circuitry 100 (FIG. 1), at which time the inhibit line 61 is negated to enable the AND gate 8 to decode the address subsequently generated by the one shot 4 and sound a test alarm, as explained further below.

The primary comparison element of the comparator module 21A can be any suitable device known to those skilled in the art, including programmable logic arrays. Scanning elements may be used, but are not preferred because the necessary pulse width of the presented address would have to be increased beyond preferred limits and addresses may not be recognized if there is a timing overlap between signals from separate remote sensor stations 20A, whereas with the preferred embodiment very narrow address pulses can be detected.

The high output from the AND gate 8 is used to set a bistable multivibrator or S-R flip-flop 9 to a high output state. The high level output signal from the comparator module flip-flop 9 is then used to turn on a lamp transistor 10, which acts as a switch, activating an indicating lamp 11, which is labeled with the appropriate address 18. The indicating lamp 11 is preferably one in a panel of lamps, allowing visual indication of a group of remote sensor stations.

The output from the comparator module flip-flop 9 is also connected to the anode of one diode 51 in diode array 13. The cathodes of the diodes 51 in the array 13 are connected together, with a resistor 52 connected to ground, forming a wired-OR connection. In this manner, a high output signal generated by the flip-flop 9 from a series of comparator modules 21A are combined to generate a signal representing activation of any remote sensor station 20A having an associated comparator module 21A. The output from the diode array 13 is connected to an input of a two input AND gate 67. The inhibit signal line 61 is connected to the inverted input 68 of the AND gate 67. Therefore, when the inhibit signal 61 is active high, which occurs when a test address is initially placed on the bus 40, the AND gate 67 is disabled to disable the central monitoring system 50 during this time. After the test address has passed through the decoding logic 100 and has triggered the one shot 4, the inhibit signal is negated, as was discussed above, and the AND gate 67 is enabled to enable the central monitoring system 50. The operation of the inhibit line 61 is explained more fully below.

The output of the AND gate 67 is used to trigger a one shot 14, which provides a high level output to set a central alarm flip-flop 15 to a high output state. The high output signal from central flip-flop 15 turns on a central horn transistor 17, which in turn activates a central alarm horn 18. Activation of the central alarm horn 18 alerts an attendant who notes the address (18) and thus location of the activated remote sensor 20A and take the appropriate action.

After the comparator module 21A has been activated, the comparator module 21A may be reset by activating a momentary contact switch 12, which provides a reset signal to the reset input of the comparator module flip-flop 9, thereby setting the output of flip-flop 9 to a low state, turning off the lamp transistor 10 and the indicating lamp 11. The reset signal also resets the flip-flop 80 in FIG. 1 and is provided to testing circuitry (FIG. 3) as shown by the interconnection I. A horn reset momentary switch 16 is also provided, which, when depressed, provides a signal to reset the central flip-flop 15, thereby resetting the output of the central flip-flop 15 to a low state, turning off the central horn transistor 17 and the central alarm horn 18.

The central monitoring system 50 may be located in one location for central monitoring, or may be located in several locations to allow monitoring of selected zones. The additional locations need only have connection made to the bus 40, with operation otherwise the same. Additionally, monitoring may be performed centrally for all remote sensor stations at one location and at different locations for zones of remote sensor stations.

Referring now to FIG. 3, the present invention includes testing circuitry which enables a user to test the various remote stations 20A and comparator modules 21A. The address connectors 42, inhibit line 61, inhibit override line 62, and reset line 63 in FIGS. 2 and 3 are connected together through the circled letters A through I. The testing circuitry includes a counter 120 which preferably generates a serial bit stream that is provided to a serial in, parallel and serial out shift register 121. In the illustrated embodiment, the shift register 121 receives the input from the counter 120 and generates a parallel output that is supplied to driver circuitry 122. The shift register 121 also provides a serial input of the data it receives to a recording device 125, preferably a tape recorder according to the illustrated embodiment, to record the test addresses that are presented on the bus by the testing circuitry for later analysis.

The driver circuitry 122 outputs the lower six bits of the data that it receives through resistors 123 to the wired-OR bus 40 address connectors 42. The six signals output from the driver circuitry 122 comprise a test address that is placed on the wired-OR bus 40. The driver circuitry 122 is preferably comprised of either tri-state logic or PNP open collector transistors having their emitters connected to the positive supply voltage according to the present embodiment. The driver circuitry 122 receives an enable signal from an AND gate 140 and only provides a test address to the wired-OR bus 40 when the enable signal is asserted high. The generation of the enable signal is discussed further below. When the testing circuitry is not being used, the enable signal is negated to disable or tri-state the driver circuitry 122. The resistors 123 are included to account for instances where dual driving may occur if tri-state devices are used, such as where a test address and an address produced by the one shot 4 are on the bus simultaneously, to prevent damage should an improper address be provided to the bus 40.

The counter 120 includes a clock input which receives a clocking signal from clock generation circuitry 124. The clock generation circuitry 124 also preferably generates a clear signal to the counter 120 to clear the counter 120 before testing. The shift register 121 includes a clock input which receives a clocking signal from the clock circuitry 124. The clocking signal provided to the shift register 121 is preferably at least the number of addressing bits in bus 40 times the frequency of the clocking signal provided to the counter 120 to provide the shift register 121 with enough time to be able to receive the serial data from counter 120 and generate a parallel output to the driver circuitry 122. The counter 120 and the clock generation circuitry 124 each include enable inputs which are connected to a switch 132. Therefore, when the switch 132 is turned on, the testing circuitry is activated, and when the switch 132 is turned off, the testing circuitry is turned off or deactivated. In an alternate embodiment of the present invention, the testing circuitry is automatically activated periodically by logic (not shown) in the clock generation circuitry 124.

The counter 120 generates a test address enable signal that is provided to an input of the AND gate 140. When the shift register 121 has output a test address to the driver circuitry 122, the counter 120 asserts the test address enable signal to the AND gate 140. The second input, which is inverted, of the AND gate 140 receives a signal referred to as output prevent, as is explained below. When the output prevent signal is negated low and the test address enable signal is asserted high, then the enable output of the AND gate 140 is asserted to enable the test the address conductors 42. The test address enable signal is generated by the counter 120 to enable the driver circuitry 122 to produce each of the signals forming the test address as closely together as possible to prevent skew from occurring between each of the individual signals forming the test address and at a time in proper relation to the inhibit signal.

The counter 120 generates an inhibit output signal that is provided to the input of a two input AND gate 128. The inhibit override line 62 is connected to the second input of the AND gate 128, which is an inverted input. The output of the AND gate 128 is connected to the inhibit line 61. The inhibit override line 62 is connected to the set input of an S-R flip-flop 130. The Q output of the flip-flop 130 generates an output prevent signal that is connected to the inverted input of the AND gate 140. The shift register 121 generates an output enable signal that is connected to the other input of the AND gate 140. The AND gate 140 generates the enable signal that is supplied to the driver circuitry 122. When the output prevent signal is asserted high, the driver circuitry 122 is disabled or tri-stated, and no test addresses are presented onto the wired-OR bus 40. The reset input of the flip-flop 130 is connected to the reset line 63.

When a test of the monitoring system is desired, the switch 132 is activated, and the counter 120 begins generating a serial data stream to the shift register 121. The counter 120 also asserts a high level signal to the input of the AND gate 128 at the time that it begins generating this data stream, and this high level signal lasts until a short time after the test address is presented on the address bus. If the inhibit override line 62 is low, signifying that the remote sensors 20A and 20B have not indicated an alarm since the flip-flop 80 for the remote station 20A was last reset, then the output of the AND gate 128 follows the high level signal generated by the counter 120, as described above.

As shown in FIG. 4, the inhibit signal generated by the counter 120 is asserted high to assert the inhibit line 61 at time 152 and enable the operation of the decode logic 100 in the remote station 20A and disable the comparator modules 21A during the time that the counter 120 initially provides test addresses to the wired-OR bus 40. As shown in FIGS. 1 and 2, the asserted inhibit line 61 disables the AND gate 8 in the comparator module 21A and the AND gate 67 in the monitoring station 50 and enables the AND gate 102 in the test decoding circuitry in the remote station 20A. The shift register 121 then outputs the respective test address to the driver circuitry 122 and the counter 120 asserts the test address enable signal to the AND gate 140 at time 154 to enable the driver circuitry to present the test address to the wired-OR bus 40 at time 154. The period between times 152 and 154 is sufficient to allow the address value to be stable at the driver circuitry 122 and for the remaining portions to be ready for the address value. The comparison module 21A ignores the address because the asserted inhibit line 61 is asserted and the AND gate 8 is disabled.

If the test address presented on the address bus portion of the wired-OR bus 40 is 010010 (18), then the output of the AND gate 102 in the test decoding logic 100 in the remote station 20A is asserted, thereby triggering the one shot 4 which in turn drives the address 010010 onto the wired-OR bus 40. It is noted that two different devices may be simultaneously driving an address onto the wired-OR bus 40 during this time, these two devices being the one shot 4 and the driver circuitry 122. However, dual driving is acceptable in this instance for tri-state logic in the driver circuitry 122 because of the resistors 123 connected between the driver circuitry 122 and the address bus of the wired-OR bus 40.

After a short time sufficient to allow the test address to have passed through the decode logic 100 and triggered the one shot 4 to drive an address onto the bus, the counter 120 negates the test address enable signal to the AND gate 140 at time 156, thereby negating the enable signal to the driver circuitry 122. This discontinues the driving of the test address onto the address bus prior to removing the inhibit signal so that the comparator module 21A does not erroneously sense the address. After the driver circuitry 122 has discontinued driving the address bus, the inhibit line 61 is negated at time 158. The negated inhibit line 61 enables the AND gates 8 and 67 in the comparator module 21A and the central monitoring system 50, respectively, to enable the address presented on the wired-OR bus 40 by the diode array 5 to trigger the alarm indicators 11 and 18. The inhibit line 61 is negated only after the driver circuitry 122 discontinues driving the test address to prevent the test address from triggering one of the comparator modules 21A.

If the remote sensor 20A is activated by an actual alarm situation immediately prior to or during the conduction of a test, the flip-flop 80 is set, which asserts the inhibit override line 62 to the inverted input of the AND gate 128 to either prevent the inhibit line 61 from being asserted or to negate the inhibit line 61 if it had already been asserted, respectively. The asserted inhibit override line 62 also sets the Q output of the flip-flop 130 high, which tri-states or disables the driver circuitry 122 and thereby prevents any test addresses from being presented onto the wired-OR bus 40 until the reset signal 63 is asserted.

Therefore, an alarm system is disclosed which reduces the cabling costs associated with both installation and incremental changes to a system. The alarm system according to the present invention is simple in nature and requires no intelligence such as microprocessors at the remote sensors or the central monitoring system. The alarm system also includes an efficient testing mechanism which enables a user to selectively test various portions of the monitoring system without interfering with the operation of the system.

It will be appreciated that the various structural members that make up the alarm system can be formed in numerous embodiments without departing from the teachings of the present invention.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

I claim:

1. An alarm indicating system comprising:

a parallel wired-OR bus, said bus being comprised of a plurality of parallel conductors, said conductors including a plurality of control conductors and n parallel address conductors forming an address bus which is used to generate bit positions in a binary number n bits long;

a plurality of remote sensors connected to said wired-OR bus, each of said remote sensors having a unique address, said address being represented as a binary number, and including:

means coupled to said wired-OR bus for momentarily presenting said remote sensor address to said address bus upon activation of said remote sensor by an external alarm condition;

means coupled to said address bus for sensing a test address on said address bus;

means coupled to said sensing means for comparing said test address with said address of said remote sensor; and means coupled to said comparing means and said presenting means for activating said presenting means when said test address matches said address of said remote sensor;

a central monitoring system comprised of a plurality of comparators connected to said wired-OR bus, each of said comparators being assigned an address corresponding to a unique remote sensor address, said comparators including:

means for sensing a presented address on said address bus;

means for comparing said presented address with said address of said comparator; and means for signalling when said presented address matches said address of said comparator; and a testing means connected to said wired-OR bus for momentarily presenting said remote sensor test addresses to said address bus upon activation of said testing means.

2. The alarm indicating system of claim 1, wherein said remote sensor presented address comparing means includes an enable input so that said comparison is made only if said enable input is true;

wherein said central monitoring system comparator presented address comparing means includes a disable input so that said comparison is made only if said disable input is false;

wherein said plurality of control conductors in said wired-OR bus includes an inhibit conductor that is coupled to each of said remote sensor comparison enable inputs and of said plurality of central monitoring system comparator disable inputs; and wherein said testing means further includes means coupled to said inhibit conductor for generating a true value on said inhibit conductor when said remote sensor test addresses are presented on said address bus by said testing means.

3. The alarm indicating system of claim 2, wherein said means for generating a true value on said inhibit conductor includes a means for generating an inhibit signal pulse, said inhibit signal pulse being asserted and placed on said inhibit conductor before said remote sensor test address is presented on said address bus and said inhibit signal pulse being negated and removed from said inhibit conductor after said remote that address is removed from said address bus.

4. The alarm indicating system of claim 3, further comprising:

wherein said plurality of control conductors includes an inhibit override conductor;

wherein each of said remote sensors includes means for determining activation of said remote sensors by said external alarm condition and generating an inhibit override signal indicative thereof, said inhibit override signal being coupled to said inhibit override conductor; and wherein said testing means further includes a disable input which is coupled to said inhibit override conductor, wherein said testing means is disabled when any of said remote sensors are activated by said external alarm condition and said inhibit override signal is provided.

5. The alarm indicating system of claim 4, wherein said inhibit signal pulse generating means includes an enable input which is coupled to said inhibit override conductor; and wherein said signal pulse generating means is disabled when said inhibit override signal is provided by any of said remote sensors.

6. The alarm indicating system of claim 4, wherein said testing means further includes:

means for generating a plurality of signals representing remote sensor test addresses and presenting said signals in a parallel fashion; and driver means coupled to said address bus and said address signal generating means for receiving said remote sensor addresses and providing said remote sensor addresses to said address bus.

7. The alarm indicating system of claim 6, wherein said testing means further includes:

recording means coupled to said address signal generating means for recording said remote sensor addresses output to said driver means.

8. The alarm indicating system of claim 6, wherein said driver means includes said testing means disable input and said driver means is disabled when said inhibit override signal is provided by any of said remote sensors.

* * * * *